US008800795B2

(12) United States Patent
Hwang

(10) Patent No.: US 8,800,795 B2
(45) Date of Patent: Aug. 12, 2014

(54) ICE CHEST HAVING EXTENDING WALL FOR VARIABLE VOLUME

(76) Inventor: Hyung Keun Hwang, Pyeongtaek-si (KR)

( * ) Notice: Subject to any disclaimer, the term of this patent is extended or adjusted under 35 U.S.C. 154(b) by 88 days.

(21) Appl. No.: 13/636,124

(22) PCT Filed: Mar. 25, 2011

(86) PCT No.: PCT/KR2011/002083

§ 371 (c)(1),
(2), (4) Date: Oct. 10, 2012

(87) PCT Pub. No.: WO2011/119010

PCT Pub. Date: Sep. 29, 2011

(65) Prior Publication Data

US 2014/0054298 A1 Feb. 27, 2014

(30) Foreign Application Priority Data

Mar. 26, 2010 (KR) ..... 10-2010-0027242

(51) Int. Cl.
*B65D 6/24* (2006.01)

(52) U.S. Cl.
USPC ..... 220/4.03; 62/371; 62/457.5; 206/545; 220/8; 220/23.86; 220/23.88; 220/324; 220/551; 220/592.25; 220/915.2; 220/528

(58) Field of Classification Search
USPC ..... 62/371, 457.2–457.8; 206/196, 198, 206/545, 547, 561–565; 220/4.03, 8, 220/23.83–23.89, 324, 507, 510, 521–523, 220/526, 528, 553–556, 573.1–573.5, 585, 220/592.2–592.27, 720, 722, 915.2; 229/199; 426/115, 119
See application file for complete search history.

(56) References Cited

U.S. PATENT DOCUMENTS 281,268 A * 7/1883 Haskell ..... 190/105
450,527 A * 4/1891 Poyner ..... 206/547

(Continued)

FOREIGN PATENT DOCUMENTS

KR 10-1996-0024135 A 7/1996
KR 20-0231463 Y1 7/2001
KR 10-2005-0081338 A 8/2005

OTHER PUBLICATIONS

International Search Report of PCT/KR2011/002083 dated Nov. 29, 2011.

*Primary Examiner* — Anthony Stashick
*Assistant Examiner* — Ned A Walker
(74) *Attorney, Agent, or Firm* — Justin H. Kim; Maxon IP LLC

(57) ABSTRACT

Disclosed therein is to an icebox, which has volume varying means so as to selectively vary a storage space of the icebox for storing various food supplies and to simultaneously store various portable means and household items to thereby prevent convenience in use. The icebox includes: an icebox body having a bottom and side walls, which are filled with insulating material, and a storing part opened at one side for storing foods therein; a cover for selectively opening and closing the opened side of the icebox body, the cover having a receiving part; a capacity varying part interposed between the icebox body and the cover and slidably joined to the storing part so as to vary the capacity of the storing part. Because the capacity of the storing part of the icebox is selectively varied, the icebox enables the user to utilize the space of the storing part in various ways, can accommodate various kinds of food supplies and household items, and is convenient in going long distance.

7 Claims, 9 Drawing Sheets

(56) References Cited

U.S. PATENT DOCUMENTS

| | | | | | |
|---|---|---|---|---|---|
| 601,798 | A | * | 4/1898 | Slomka | 62/371 |
| 634,070 | A | * | 10/1899 | Smith | 62/460 |
| 882,824 | A | * | 3/1908 | Hall | 62/457.7 |
| 1,015,455 | A | * | 1/1912 | Neesham | 220/8 |
| 1,267,388 | A | * | 5/1918 | Dodson | 312/277 |
| 1,336,776 | A | * | 4/1920 | Drinkwater | 206/545 |
| 1,499,369 | A | * | 7/1924 | Holland | 229/120.32 |
| 1,681,110 | A | * | 8/1928 | Friedman | 206/199 |
| 1,895,864 | A | * | 1/1933 | Ricci | 62/415 |
| 2,215,274 | A | * | 9/1940 | Peterson | 62/457.6 |
| 2,457,043 | A | * | 12/1948 | Histand | 220/592.2 |
| 2,574,384 | A | * | 11/1951 | George | 229/125.23 |
| 2,610,472 | A | * | 9/1952 | Maxwell | 62/166 |
| 2,740,546 | A | * | 4/1956 | Kowalski | 220/23.88 |
| 3,025,948 | A | * | 3/1962 | Appelt | 206/546 |
| 3,938,688 | A | * | 2/1976 | Ryan | 220/23.8 |
| D255,085 | S | * | 5/1980 | Free et al. | D7/368 |
| 4,364,234 | A | * | 12/1982 | Reed | 62/3.3 |
| 4,509,587 | A | * | 4/1985 | Clark et al. | 165/61 |
| 5,181,394 | A | * | 1/1993 | Schea et al. | 62/371 |
| 5,333,751 | A | * | 8/1994 | Santucci, Sr. | 206/423 |
| 5,715,962 | A | * | 2/1998 | McDonnell | 220/4.03 |
| 5,912,033 | A | * | 6/1999 | Ferguson | 426/124 |
| 5,934,099 | A | * | 8/1999 | Cook et al. | 62/457.2 |
| 5,967,323 | A | * | 10/1999 | Siragusa | 206/499 |
| 6,044,650 | A | * | 4/2000 | Cook et al. | 62/130 |
| D424,425 | S | * | 5/2000 | Ngai | D9/756 |
| 6,146,673 | A | * | 11/2000 | Ferguson | 426/115 |
| 6,153,237 | A | * | 11/2000 | Ferguson | 426/115 |
| 6,296,120 | B1 | * | 10/2001 | Danko | 206/564 |
| 6,527,123 | B1 | * | 3/2003 | Ausaf | 206/549 |
| 6,612,454 | B1 | * | 9/2003 | Lin | 220/23.88 |
| 7,025,221 | B2 | * | 4/2006 | Kim | 220/324 |
| D553,902 | S | * | 10/2007 | Barber | D7/357 |
| D572,539 | S | * | 7/2008 | Swinford et al. | D7/610 |
| 7,562,787 | B2 | * | 7/2009 | Serrano | 220/507 |
| 7,861,552 | B1 | * | 1/2011 | Hughes | 62/457.2 |
| 7,909,371 | B1 | * | 3/2011 | Mihlbauer et al. | 292/80 |
| 8,091,705 | B1 | * | 1/2012 | McCutchen | 206/486 |
| D653,767 | S | * | 2/2012 | Lovshe | D24/230 |
| 2001/0054570 | A1 | * | 12/2001 | Danko | 206/756 |
| 2004/0118850 | A1 | | 6/2004 | Kim | |
| 2007/0007291 | A1 | * | 1/2007 | Gunn | 220/23.86 |

* cited by examiner

ICE CHEST HAVING EXTENDING WALL FOR VARIABLE VOLUME

BACKGROUND OF THE INVENTION

1. Field of the Invention

The present invention relates to an icebox, and more particularly, to an icebox, which has volume varying means so as to selectively vary a storage space of the icebox for storing various food supplies and to simultaneously store various portable means and household items to thereby prevent convenience in use.

2. Background Art

In general, an icebox is made of a material having a good heat insulation property to prevent decomposition of the contents, such as food or drinks, which may be cooked on the site, while a leisure activity, such as trip or fishing, and to keep freshness of foods for a long time, and contains ice or refrigerant packs inside a main body of the icebox to keep the foods in good conditions.

Such an icebox generally includes an opened storing part for storing foods or drinks inside the main body, and the storing part is opened and closed by a cover.

Such an icebox has the main body and the cover simply formed using foam polystyrene (blowing styrol). However, recently, the icebox has a main body having a double case, which is made of plastic with strong durability so as to be easy in carrying and is filled with insulating material so as to enhance durability and heat insulation property of the icebox.

Moreover, the main body of the icebox has hand-grips disposed at both sides thereof so as to be easy in carrying.

However, such an icebox has several problems as follows.

First, because the capacity of a storing part to store foods is limited, it is impossible to store lots of foods exceeding the storing capacity. Particularly, in the case that refrigerant like ice is inserted into the icebox, the food storing space is reduced more, and hence, there is a limit to store foods. In this case, a user demands another storing means or additional icebox.

Second, because the icebox has no additional storage space besides the storing part, there is an inconvenience that the user has to separately carry food supplies and household items to cook food.

Third, the user can carry the icebox body using the hand-grips. In this instance, if the icebox is small-sized or contains a small quantity of food therein, one person can lift up and carry the icebox, but if the icebox is large-sized, users feel difficulty in lifting up and carrying the icebox because two persons have to lift up and carry the icebox.

SUMMARY OF THE INVENTION

Accordingly, the present invention has been made to solve the above-mentioned problems occurring in the prior arts, and it is an object of the present invention to provide an icebox, which can selectively vary the volume of a storing part of the icebox according to an amount of food stored in the icebox, and which is easy to store various kinds of household items and to carry the icebox.

To accomplish the above object, according to the present invention, there is provided an icebox including: an icebox body having a bottom and side walls, which are filled with insulating material, and a storing part opened at one side for storing foods therein; a cover for selectively opening and closing the opened side of the icebox body, the cover having a receiving part; a capacity varying part interposed between the icebox body and the cover and slidably joined to the storing part so as to vary the capacity of the storing part.

The capacity varying part has the inside communicating with the storing part of the icebox body 100 and includes: a seating portion seated on the upper face of the side walls of the icebox body; and lifting frames bent and extending from the seating portion toward the storing part and having side wall receiving portions for receiving the side walls when they are slidably joined to the icebox body.

In this instance, at least one fastener is disposed on the outer circumferential surface of the lifting frame of the capacity varying part, protruding outwardly and having a plurality of fastening slots. Separation portions are formed on the upper faces of the side walls along the upper faces of the side walls of the icebox body, and have a predetermined depth toward the bottom so that the lifting frame of the capacity varying part can be slidably joined. Guide groove is formed on the side wall at a position corresponding to each fastener, and communicates with the separation portion in such a fashion that the fastener is slidably inserted when the lifting frame is joined. A position determining pin is slidably arranged in the guide groove and fit into the fastening slot of the fastener sliding along the guide groove to thereby keep the position of the lifting frame.

It is preferable that the side wall includes: a stepped jaw formed on the inner circumferential surface of the upper portion thereof and extending in a direction of the storing part; and a separation preventing jaw formed on the inner circumferential surface of the lower portion thereof and retained to the stepped jaw of the side wall to thereby prevent a separation of the lifting frame.

It is preferable that the receiving part of the cover includes: a tray having a predetermined depth for receiving various kinds of food supplies and household items therein; and an auxiliary cover disposed on an upper portion of the receiving part for selectively opening and closing the receiving part.

It is preferable that the tray further includes a cup receiving recess having a predetermined depth in such a fashion that cups are seated thereon.

It is preferable that the cover further includes a grasping recess formed on the outer circumferential surface thereof for varying the capacity varying part.

Moreover, it is preferable that the icebox body further includes: hand-grips respectively rotatably joined to both outer faces of the side walls through fixing members; and traction hand-grips being wider and longer than the hand-grips and rotatably joined to the fixing members, the traction hand-grips having an extendable length.

Furthermore, it is preferable that the traction hand-grip includes: a rotational bar having a through hole formed in the outer circumferential surface and both ends rotatably joined to the fixing member; an elastic member made with an elastic plate and having a protrusion formed at the center thereof, the elastic member being disposed on the inner circumferential surface of the rotational bar while keeping its elasticity so that the protrusion is fit into the through hole; and a variable bar slidably joined to the other end of the rotational bar and having a plurality of position fixing holes formed on the outer circumferential surface thereof and spaced apart from one another at predetermined intervals so that the protrusion fit into the through hole is located.

The icebox according to the present invention has following effects.

First, the icebox can vary the volume of the storing part as large as the excessive amount of food even though foods stored in the icebox exceed the storage capacity of the icebox.

Therefore, the icebox according to the present invention is economical because it does not need additional storing means or additional icebox to store excessive foods.

Second, the icebox according to the present invention remove inconvenience in carrying because it has the receiving part for receiving various kinds of food supplies and household items to cook foods in the icebox.

Third, the icebox according to the present invention is convenient in long-distance movement because it has traction hand-grips.

BRIEF DESCRIPTION OF THE DRAWINGS

The above and other objects, features and advantages of the present invention will be apparent from the following detailed description of the preferred embodiment of the invention in conjunction with the accompanying drawings, in which.

DETAILED DESCRIPTION OF THE PREFERRED EMBODIMENT

Figure 1:
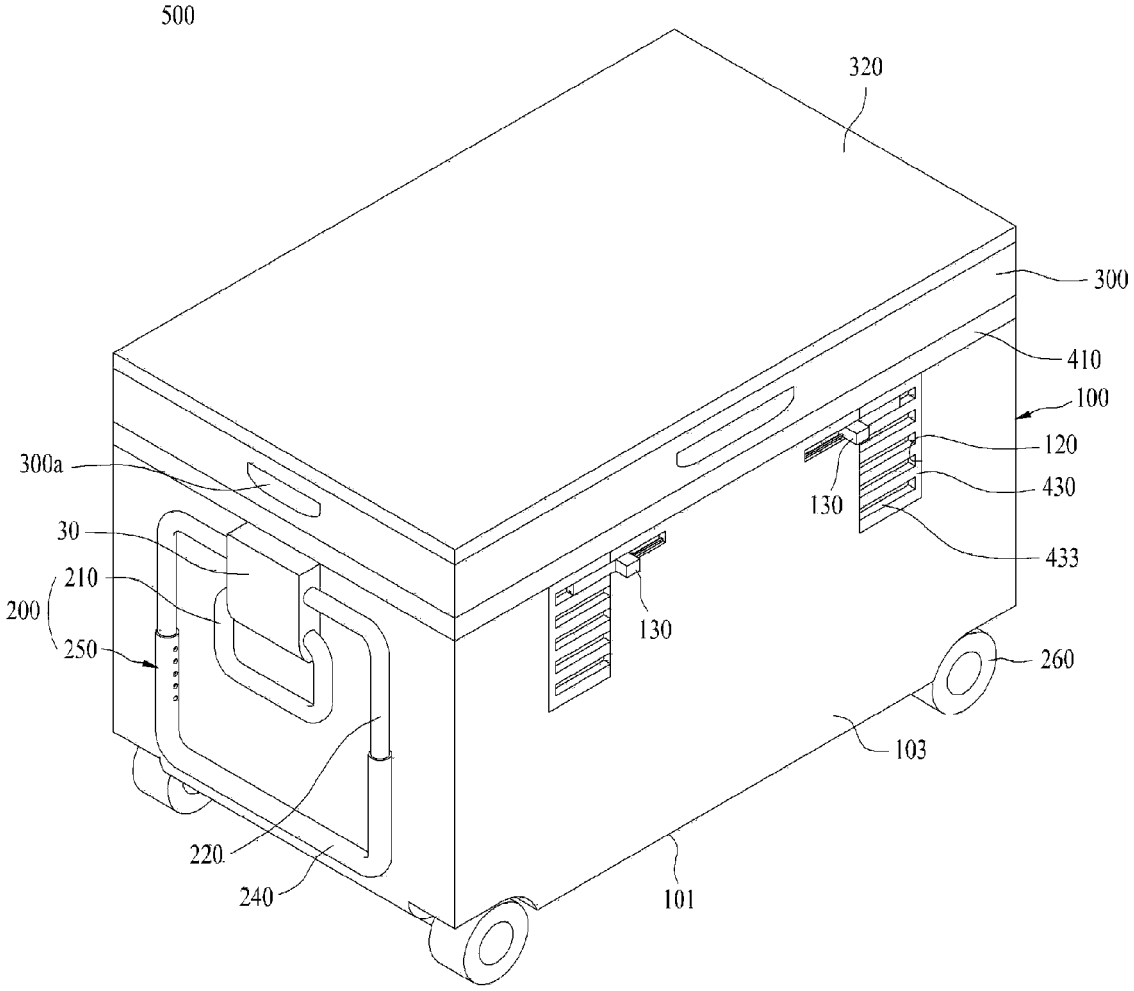
FIG. 1 is a perspective view of an icebox according to the present invention.

Description will now be made in detail of preferred embodiment of the present invention with reference to the attached drawings. Embodiments and drawings of the present invention are shown by way of example to promote understanding of the present invention, and hence, it should be understood that there is no intent to limit example embodiments of the present invention to the particular forms disclosed.

The present invention provides an icebox, which can store lots of foods therein and receive various kinds of household items and food supplies and is easy in carrying by varying the capacity of a storing part even though foods to be stored in the icebox exceed a storage capacity of the icebox.

The shape of the icebox, which will be described later, is just an example to explain the present invention, and hence, is not restricted to the above.

As shown in FIGS. 1 to 9, the icebox 500 includes an icebox body 100 having a bottom 101 and side walls 103, which are filled with insulating material 10, the icebox body 100 being opened at one side and having a storing part 107 for storing foods therein; a cover 300 for selectively opening and closing the opened side of the icebox body 100, the cover 300 having a receiving part 310; and a capacity varying part 400 interposed between the icebox body 100 and the cover 300 and slidably joined to the storing part 107 so as to vary the capacity of the storing part 107.

The icebox body 100 is formed in a rectangular parallelepiped shape, and has the storing part 107 formed by the bottom 101 for finishing a lower portion thereof and four side walls 103 formed integrally with the bottom 101 so as to have a depth sufficient to store foods therein in an opened state.

The bottom 101 and the side walls 103 are filled with the insulating material 10 to keep the inside temperature of the icebox 500 and to block heat from the outside, such that the foods stored in the icebox 500 can maintain freshness.

Figure 2:
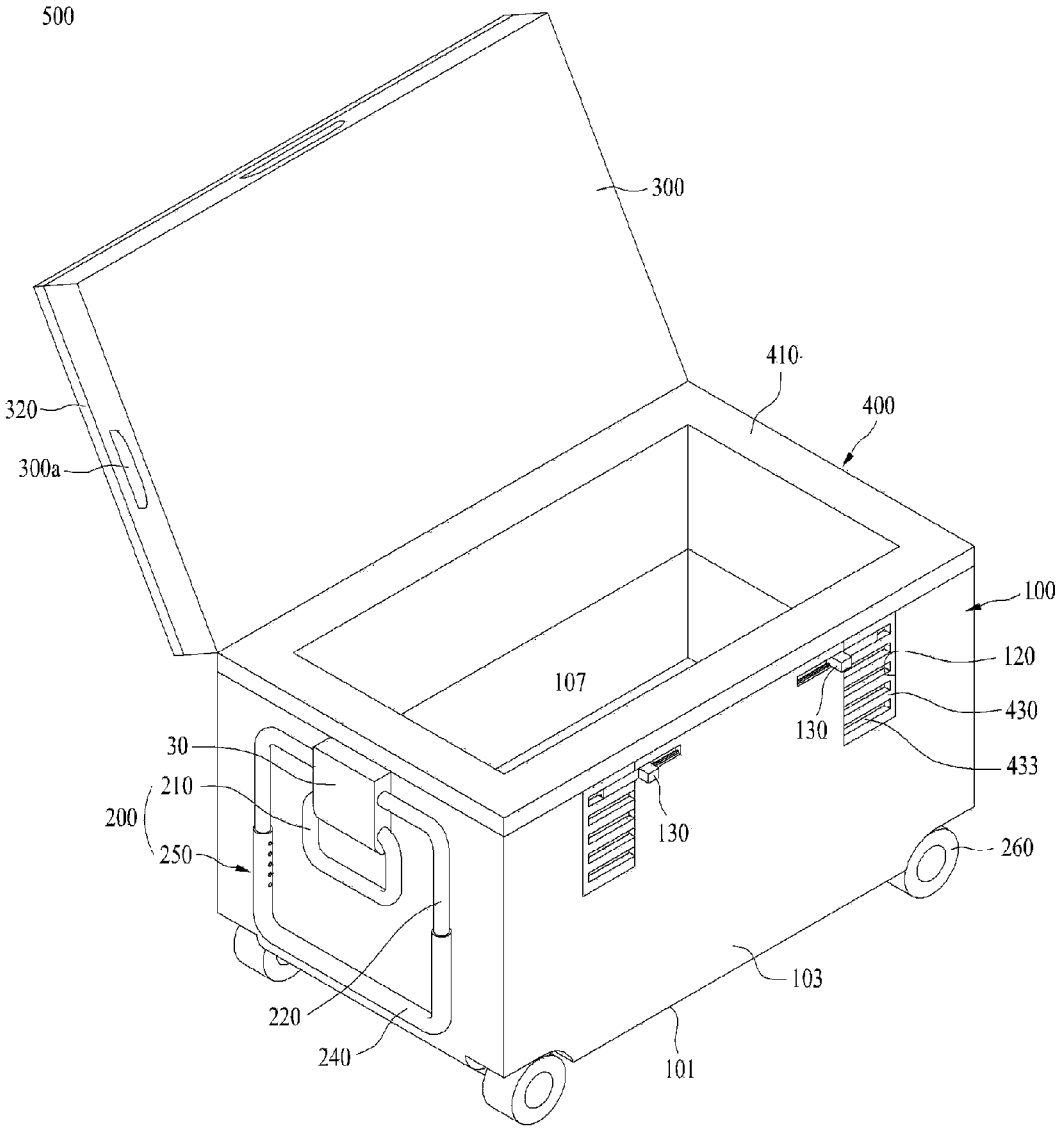
FIG. 2 is a perspective view showing a state where a cover of the icebox is opened.

Next, the cover 300 is arranged on an upper portion of the icebox 500 and has a shape corresponding to an upper face of the icebox 500. Moreover, the cover 300 selectively opens and closes the storing part 107 opened as illustrated in FIG. 2.

In this instance, the cover 300 is rotatably joined to one side of the capacity varying part 400, which will be described later, through a hinge 20 so as to selectively open and close the storing part 107.

In the meantime, the cover 300 includes a grasping recess 300*a* formed on the outer circumferential surface thereof for grasping the capacity varying part 400, which slides to vary the capacity of the storing part 107 of the icebox body 100.

Figure 3:
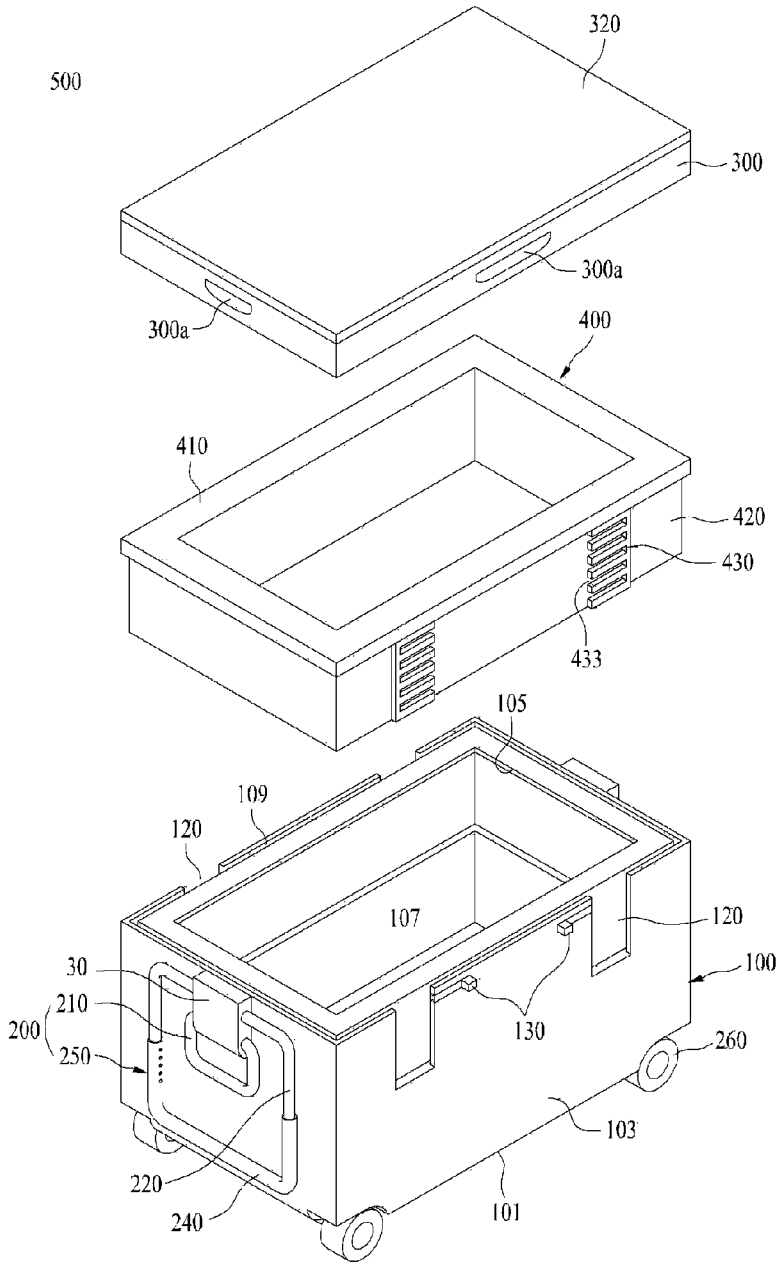
FIG. 3 is an exploded perspective view of the cover and a capacity varying part of the icebox according to the present invention.

As shown in FIG. 3, the receiving part 310 has a predetermined depth downwardly from the upper face of the cover 300 and includes a tray 330 seated on the receiving part 310 to store various food supplies and household items therein.

In this instance, the tray 330 includes a cup receiving recess 333 having a predetermined depth to receive cups therein and a plurality of seating recesses of various shapes formed at one side of the cup receiving recess 333 for seating various food supplies and household items therein.

The receiving part 310 may have various types of trays 33 having various functions, besides the above tray 330, and may store tools necessary for cooking, such as food trays, cutting boards, spice jars, and so on.

Accordingly, the icebox having the receiving part 310 can store the food supplies and various household items, which are carried separately, so that it is easy to carry.

Meanwhile, an auxiliary cover 320 for preventing a loss of the food supplies and the household items stored in the receiving part 310 and for selectively opening and closing the receiving part 310 is disposed on an upper portion of the receiving part 310. The auxiliary cover 320 is rotatably joined to one side of the cover 300 through a hinge 320. (See FIG. 5)

Next, the capacity varying part 400 has a shape corresponding to the cover 300, is interposed between the icebox body 100 and the cover 300 and slidably joined to the storing part 107 to vary the capacity of the storing part 107 in which foods are stored.

Figure 4:
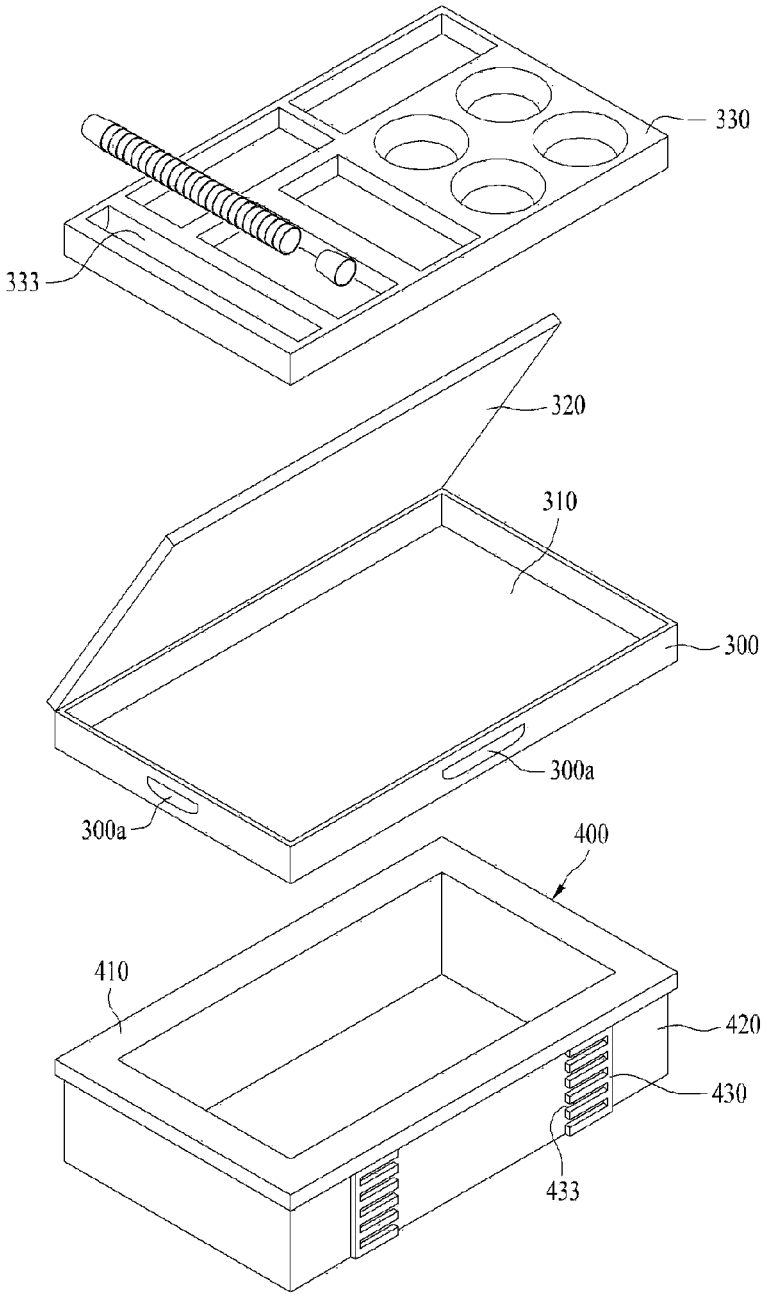
FIG. 4 is an exploded perspective view showing a state where components of the icebox are assembled.
Figure 5:
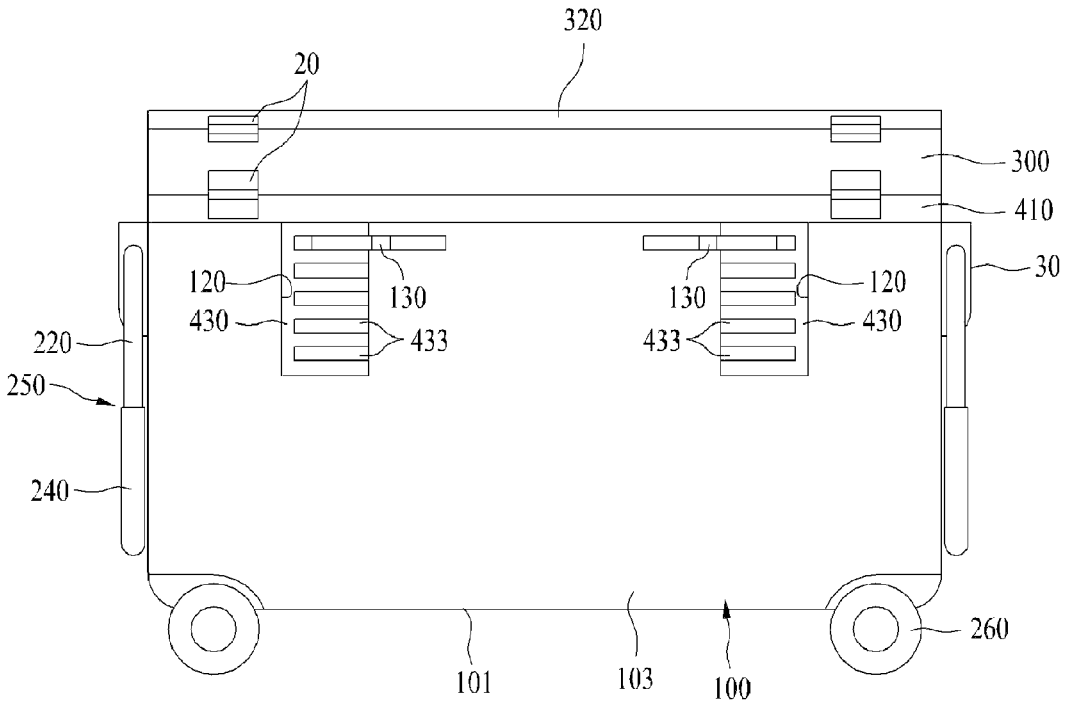
FIG. 5 is a rear view showing a rear face of the icebox.

As shown in FIGS. 3 and 4, the inside of the capacity varying part 400 communicates with the storing part 107 of the icebox body 100, and includes: a seating portion 410 seated on the upper face of the side walls 103 of the icebox body 100; and lifting frames 420 bent and extending from the seating portion 410 toward the storing part 107 and having side wall receiving portions 423 for receiving the side walls 103 when they are slidably joined to the icebox body 100.

The seating portion 410 has a shape corresponding to the upper face of the side wall 103 of the icebox body 100 and is seated on the upper face of the side wall 103, such that the capacity varying part 400 can be interposed between the icebox body 100 and the cover 300.

Each of the lifting frames 420 has a predetermined length in a direction of the storing part 107, and determines a capacity of the storing part 107, which can be varied to the largest, according to length of the lifting frame 420.

In this instance, because the length of the lifting frame 420 may be varied according to the height of the icebox 500, the length of the lifting frame 420 is not limited and can be selectively used.

The capacity of the storing part 107 of the icebox 500 is varied through fasteners 430 formed on the lifting frames 420, separation portions 109 formed on the upper face of the side walls 103 of the icebox body 100, guide grooves 120 formed in the side walls 103, and position-determining pins 130 slidably formed on one side of the guide groove 120.

It is preferable that at least one fastener 430 is formed relative to the outer circumferential surface of both sides of the lifting frame 420. The reason is to reinforce the varied and fixed state of the capacity varying part 400 and to prevent the lifting frame 420 from returning during a movement.

The separation portions 109 are formed on the upper faces of the side walls 103 along the upper faces of the side walls 103 of the icebox body 100, and have a predetermined depth toward the bottom 101 so that the lifting frame 420 of the capacity varying part 400 can be slidably joined.

In this instance, it is preferable that the depth of the separation portion 109 corresponds to length of the lifting frame 420.

The guide groove 120 is formed on the side wall 103 at a position corresponding to each fastener 430 of the lifting frame 420, and communicates with the separation portion 109 in such a fashion that the fastener 430 is slidably inserted when the lifting frame 420 is slidably joined.

Of course, the guide groove 120 has a shape corresponding to the fastener 430.

Moreover, the number of the fasteners 430 and the number of the guide grooves 120 are not limited because they can be changed according to the size of the icebox 500.

The position determining pin 130 is slidably arranged at one side of the guide groove 120 so as to keep the position of the lifting frame 420, which is fit and varied into a fastening slot 433 of the fastener 430 sliding along the guide groove 120.

Furthermore, the side wall 103 includes: a stepped jaw 105 formed on the inner circumferential surface of the upper portion thereof and extending in a direction of the storing part 107; and a separation preventing jaw 425 formed on the inner circumferential surface of the lower portion thereof and retained to the stepped jaw 105 formed on the inner circumferential surface of the upper portion of the side wall 103 to thereby prevent a separation of the lifting frame 420.

In the meantime, the ice body 500 includes castors 260 rotatably mounted on the bottom 101 of the icebox body 100 so that a user can easily carry the icebox 500.

A pair of castors 260 may be disposed at one side of the bottom 101 or each of the castors 260 may be disposed at each corner of the bottom 101.

Additionally, the icebox may further include grasping means 200 having hand-grips 21 and traction hand-grips 250 enabling the user to easily carry the icebox 500.

Figure 6:
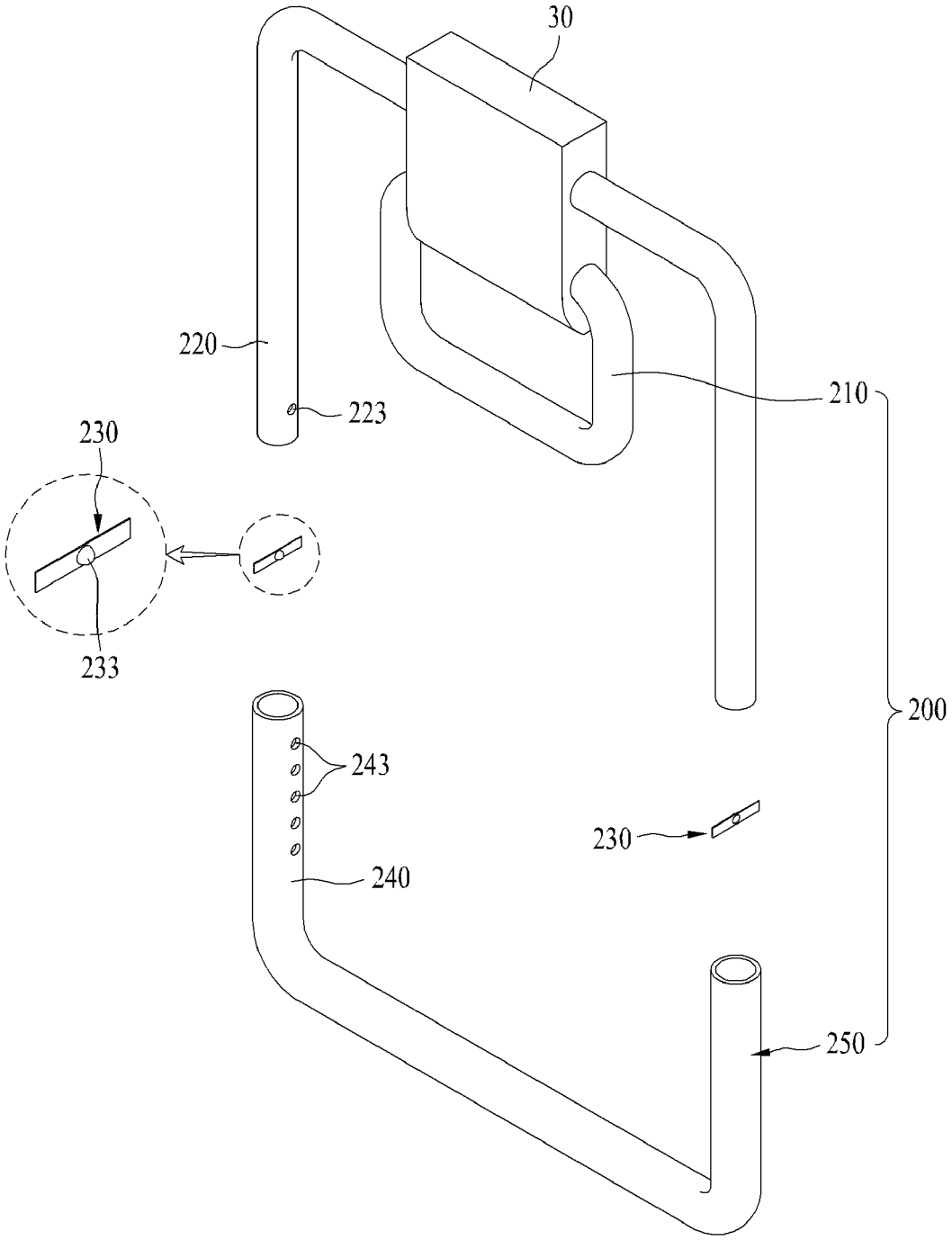
FIG. 6 is a partially exploded perspective view of a traction hand-grip of the icebox.
Figure 7:
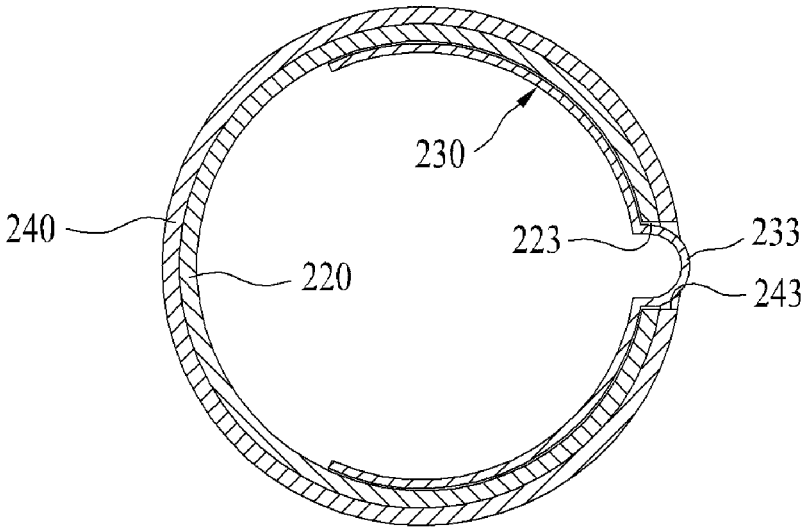
FIG. 7 is a partially sectional view showing an assembled state of FIG. 6.

As shown in FIGS. 6 and 7, the hand-grips 210 are respectively rotatably joined to both outer faces of the side walls 103, which form the icebox body 100, through fixing members 30, and are used when the user lifts up and carries the icebox 500.

The traction hand-grips 250 is wider and longer than the hand-grips 210 and rotatably joined to the fixing members 30, and is used when the user draws and carries the icebox 500, and has an extendable length.

The traction hand-grip 250 includes a rotational bar 220, an elastic member 230, and a variable bar 240.

The rotational bar 220 is a cylindrical bar and has a through hole 223 formed in the outer circumferential surface and both ends rotatably joined to the fixing member 30.

The elastic member 230 is made with an elastic plate and has a protrusion 233 formed at the center thereof. The protrusion 233 is arranged inside the rotational bar 220 while keeping its elasticity so that the protrusion 233 is fit into the through hole 223.

The variable bar 240 is slidably joined to the other end of the rotational bar in such a fashion that the outer diameter of the rotational bar 220 is inserted into the variable bar 240, and has a plurality of position fixing holes 243 formed on the outer circumferential surface thereof and spaced apart from one another at predetermined intervals so that the protrusion 233 fit into the through hole 223 is located.

Because the length of the traction hand-grip 250 is increased by a sliding motion of the variable bar 240, the user can easily draw the icebox 500 and easily go long distance since the castors 260 are in contact with the ground.

The process of varying the capacity of the icebox 500 according to the present invention will be described as follows.

Figure 8:
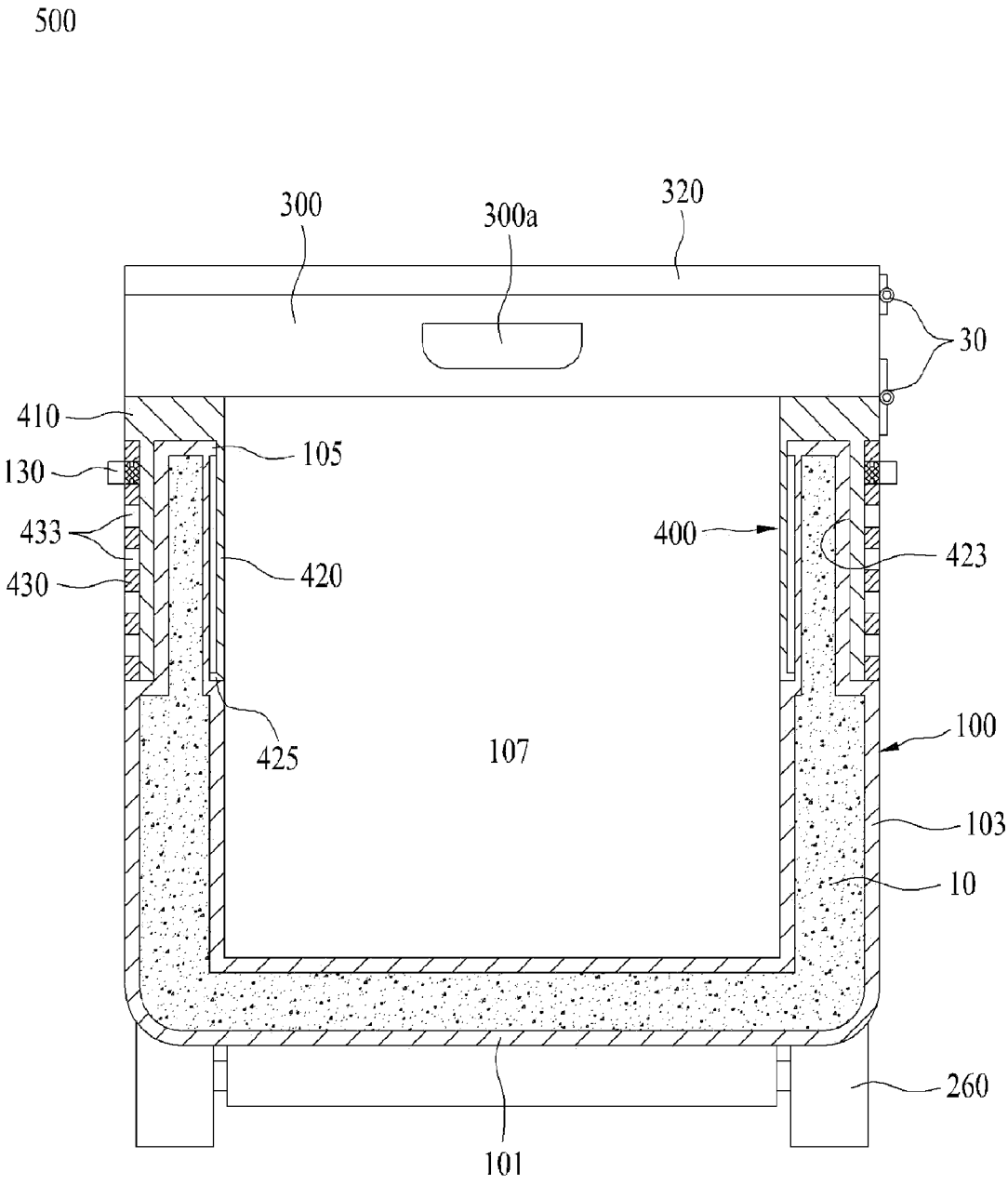
FIG. 8 is a partially sectional view showing a state of the icebox before the capacity varying part is lifted up.
Figure 9:
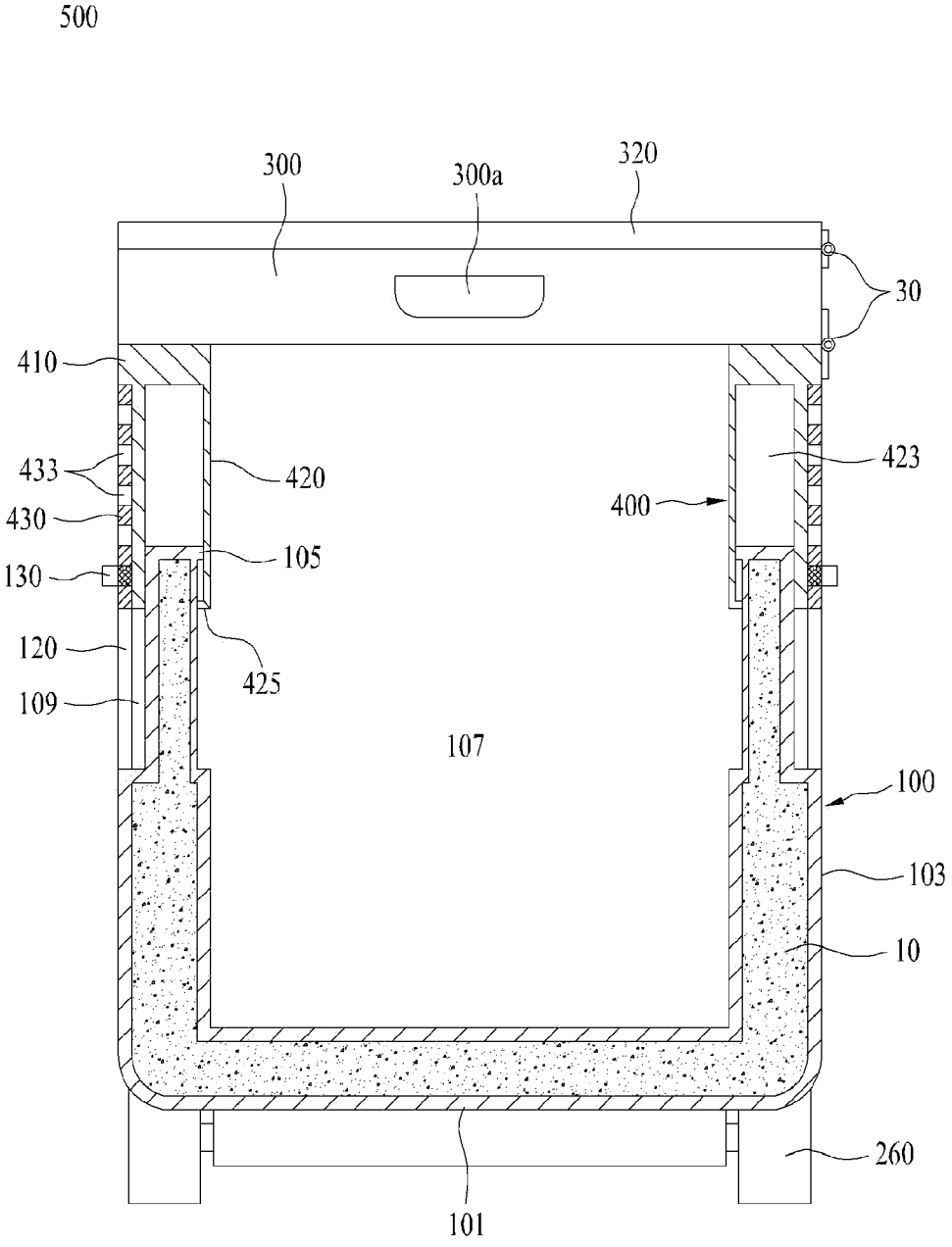
FIG. 9 is a partially sectional view showing a state of the icebox after the capacity varying part is lifted up.

As shown in FIGS. 8 and 9, in order to vary the capacity of the storing part 107 of the icebox 500, first, the user grasps the grasping recesses **300*a* formed in the cover 300 with both hands and lifts up the cover 300** in the upward direction in the drawings.

In this instance, because the cover 300 is rotatably joined with the capacity varying part 400 through the hinge 20, the capacity varying part 40 is also lifted up.

As shown in FIG. 9, the lifting frame 420 extending from the capacity varying part 400 is also lifted up, and hence, the capacity of the storing part 107 of the icebox 500 is widened.

When the lifting frame 420 is lifted up, the fasteners 430 formed on both outer circumferential surfaces of the lifting frame 420 are also lifted up along the guide grooves 120 formed on the wall body.

In this instance, when the user judges that the capacity of the storing part 107 of the icebox 500 is varied as large as the user wants, the user stops the cover 300, and then, slidably moves and fits the position determining pin 130 into the fastening slot 433 of each fastener 430.

Then, the capacity of the storing part 107 of the icebox 500 keeps the varied state.

On the contrary, if the user wants to return the storing part 107 of the icebox 500 to its original state, the user carries out the above process in reverse order.

In the meantime, in the case that the user wants to go long distance with the icebox 500, first, the user rotates the traction hand-grips 250 rotatably joined to the fixing members 30 and draws the icebox 500 while holding the variable bars 240.

Then, the icebox 500 moves on the ground by the user's drawing power and the rotation of the castors 260.

Meanwhile, if a distance between the user and the icebox 500 is short, the user pulls the variable bar 240 to selectively extend the length of the variable bar 240, such that the user can keep a proper distance from the icebox 500. If the distance between the user and the icebox 500 becomes narrowed, it causes inconvenience in carrying due to a mutual contact.

After that, when movement of the icebox 500 is finished, the user slidably pushes the variable bar 240 toward the rotational bar 220 so that the variable bar 240 is returned to its original condition.

As described above, because the capacity of the storing part 107 of the icebox 500 is selectively varied, the icebox 500 according to the present invention enables the user to utilize the space of the storing part 107 in various ways, can accommodate various kinds of food supplies and household items, and is convenient in going long distance.

While the present invention has been particularly shown and described with reference to exemplary embodiments thereof, it will be understood by those of ordinary skill in the art that various changes in form and details may be made therein without departing from the spirit and scope of the present invention as defined by the following claims.

For instance, the shape of the icebox 500, the rotatably joining method of the cover 300 and the auxiliary cover 320, the shape of the grasping recess 300*a*, the shape and kinds of the trays 330, the shape and the structure of the capacity varying part 400, the shapes of the fasteners 430 and the fastening slots 433, the depth of the separation portions, the length of the lifting frame 420, the number of the fasteners 430 and the guide grooves 120, the number of the castors 260, the structure and extending method of the traction hand-grips 250, kinds of the elastic member 230, and so on may not be standards to limit the technical scope of the present invention, and the scope of the present invention shall be restricted by the following claims.

What is claimed is:

1. An icebox comprising:

an icebox body (100) having a bottom (101) and side walls (103), which are filled with insulating material (10), and a storing part (107) opened at one side for storing foods within the storing part; a cover (300) for selectively opening and closing the opened side of the icebox body (100), the cover (300) having a receiving part (310);

a capacity varying part (400) interposed between the icebox body (100) and the cover (300) and slidably joined to the storing part (107) so as to vary the capacity of the storing part (107), the capacity varying part (400) having an inside communicating with the storing part (107) of the icebox body (100) and including: a seating portion (410) seated on an upper face of the side walls (103) of the icebox body (100); and lifting frames (420) bent and extending from the seating portion (410) toward the storing part (107) and having side wall receiving portions (423) for receiving the side walls (103) when they are slidably joined to the icebox body (100); and at least one fastener (430) disposed on an outer circumferential surface of the lifting frames (420) of the capacity varying part (400), the at least one fastener protruding outwardly and having a plurality of fastening slots (433), wherein separation portions (109) are formed along the upper faces of the side walls (103) of the icebox body (100), and have a predetermined depth toward the bottom (101) so that the lifting frames (420) of the capacity varying part (400) can be slidably joined to the side walls, wherein a guide groove (120) is formed on the side walls (103) at a position corresponding to each at least one fastener (430), and communicates with the separation portions (109) so that the at least one fastener (430) is slidably inserted when the lifting frames (420) is joined, and wherein a position determining pin (130) is slidably arranged in the guide groove (120) and fit into the fastening slots (433) of the fastener (430), the position determining pin sliding along the guide groove (120) to maintain a position of the lifting frames (420).

2. The icebox according to claim 1, wherein the side walls (103) comprise: a stepped jaw (105) formed on an inner circumferential surface of an upper portion of the sidewalls and the stepped jaw extending in a direction of the storing part (107); and a separation preventing jaw (425) formed on the an circumferential surface of a lower portion of the sidewalls and the separation preventing jaw retained to the stepped jaw (105) of the side walls (103) to prevent a separation of the lifting frames (420).

3. The icebox according to claim 1, wherein the receiving part (310) of the cover (300) comprises:

a tray (330) having a predetermined depth for receiving various kinds of food supplies and household items within the tray; and an auxiliary cover (320) disposed on an upper portion of the receiving part (310) for selectively opening and closing the receiving part (310).

4. The icebox according to claim 3, wherein the tray (330) further comprises a cup receiving recess (333) having a predetermined depth for receiving cups.

5. The icebox according to claim 1, wherein the cover (300) further comprises a grasping recess (300*a*) formed on an outer circumferential surface of the cover for varying the capacity varying part (400).

6. The icebox according to claim 1, wherein the icebox body (100) further comprises:

inner bail handles (210) respectively joined to outer faces of the side walls (103) through fixing members (30); and outer bail handles (250) joined to the fixing members (30) and having an extendable length.

7. The icebox according to claim 6, wherein the outer bail handles (250) comprise:

a rotational bar (220) having a through hole (223) formed in an outer circumferential surface and a first end rotatably joined to the fixing members (30);

elastic member (230) made with an elastic plate and having a central protrusion (233), the elastic member (230) being disposed on an inner circumferential surface of the rotational bar (220) so that the protrusion (233) is fit into the through hole (223); and a variable bar (240) slidably joined to a second end of the rotational bar (220) and having a plurality of individually spaced position fixing holes (243) formed on an outer circumferential surface of the variable bar at predetermined intervals.

* * * * *